US011773656B2

(12) United States Patent
Fox

(10) Patent No.: US 11,773,656 B2
(45) Date of Patent: Oct. 3, 2023

(54) LINEABLE TUBULAR

(71) Applicant: Joe Fox, Spanish Fork, UT (US)

(72) Inventor: Joe Fox, Spanish Fork, UT (US)

( * ) Notice: Subject to any disclaimer, the term of this patent is extended or adjusted under 35 U.S.C. 154(b) by 0 days.

(21) Appl. No.: 17/901,451

(22) Filed: Sep. 1, 2022

(65) Prior Publication Data

US 2022/0412171 A1 Dec. 29, 2022

(51) Int. Cl.
*E21B 17/042* (2006.01)
*E21B 17/02* (2006.01)
*E21B 17/10* (2006.01)

(52) U.S. Cl.
CPC ..... *E21B 17/0283* (2020.05); *E21B 17/1007* (2013.01)

(58) Field of Classification Search
CPC ..... E21B 17/003; E21B 17/00; E21B 17/22; E21B 17/04; E21B 17/042; E21B 17/02
See application file for complete search history.

(56) References Cited

U.S. PATENT DOCUMENTS 2,128,111 A * 8/1938 Woods ..... E21B 17/04 175/325.1
2,900,028 A * 8/1959 Hanes ..... E21B 17/20 285/302
2,917,822 A * 12/1959 Boice ..... F16L 13/00 29/447
3,371,730 A * 3/1968 Newman ..... E21B 17/07 175/300
3,399,908 A * 9/1968 Kurtz ..... F16L 23/0283 29/523
3,477,506 A * 11/1969 Malone ..... E21B 43/105 166/207
4,026,583 A * 5/1977 Gottlieb ..... F16L 58/182 285/55
4,168,089 A * 9/1979 Hulslander ..... B29C 37/0082 285/197
4,220,381 A * 9/1980 van der Graaf ..... H01R 13/523 439/194
4,507,842 A * 4/1985 Werner ..... E21B 17/042 285/55
4,763,696 A * 8/1988 Abromaitis ..... B23K 33/006 138/155
5,199,153 A * 4/1993 Schulte-Ladbeck ..... F16L 58/187 264/269
6,264,244 B1 * 7/2001 Isennock ..... E21B 17/04 285/55

(Continued)

*Primary Examiner* — Kipp C Wallace

(57) ABSTRACT

A lineable tubular for use in subterranean exploration and production, such as oil, gas, and geothermal wells. The tubular may be part of a downhole tool string, including drill pipe and related downhole tools that may be found in the bottom hole assembly. The tubular may comprise a modified interior surface along its bore wall. The modified surface may comprise hard particles, rifling, threads, ridges and grooves, sand and ceramic grit, and knurling. The modified surface may aid in securing a liner within the tubular. The tubular may include connectable ends with box and pin end tool joints. The tool joints may be attached to an upset end of the tubular. The modified surface may run the length of the tubular or it may be restricted to the upset ends of the tubular and the respective tool joints. The tubular may comprise a seal gland within the tool joints.

19 Claims, 13 Drawing Sheets

(56) References Cited

U.S. PATENT DOCUMENTS

| | | | | |
|---|---|---|---|---|
| 7,498,509 | B2 * | 3/2009 | Brotzell | F16L 19/086 174/21 R |
| 2004/0020659 | A1 * | 2/2004 | Hall | E21B 43/103 166/207 |
| 2004/0055756 | A1 * | 3/2004 | Hillis | C21D 7/04 166/382 |
| 2007/0159351 | A1 * | 7/2007 | Madhavan | E21B 17/003 340/855.1 |
| 2014/0262213 | A1 * | 9/2014 | Delange | F16L 15/003 166/207 |
| 2014/0265320 | A1 * | 9/2014 | Pollack | F16L 15/004 285/334 |
| 2014/0284065 | A1 * | 9/2014 | Fraignac | E21B 17/042 166/242.6 |
| 2016/0186332 | A1 * | 6/2016 | Kriesels | E21B 17/042 427/431 |
| 2017/0191320 | A1 * | 7/2017 | Drenth | E21B 17/20 |
| 2021/0010358 | A1 * | 1/2021 | Guidry | E21B 43/26 |

* cited by examiner

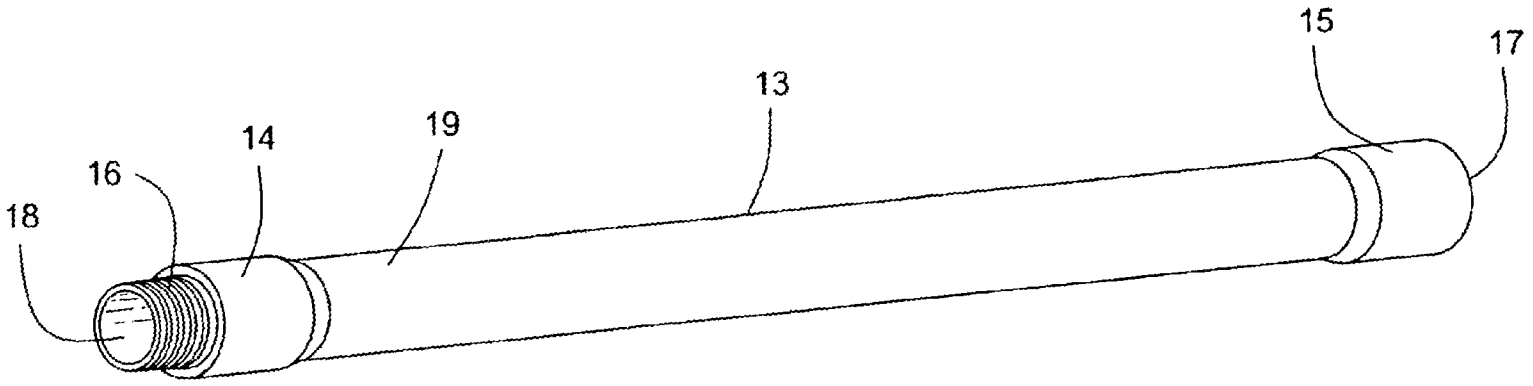
(Prior Art) FIG. 7

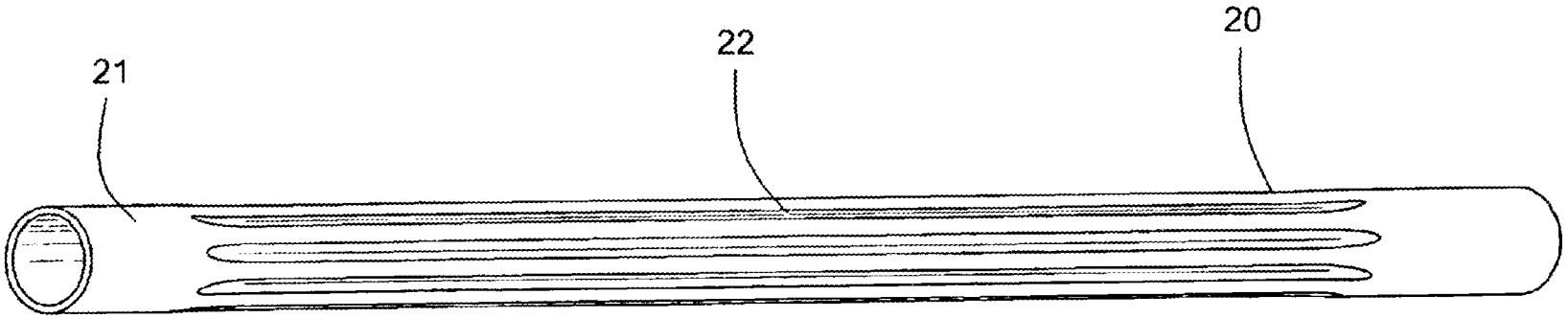
(Prior Art) FIG. 8

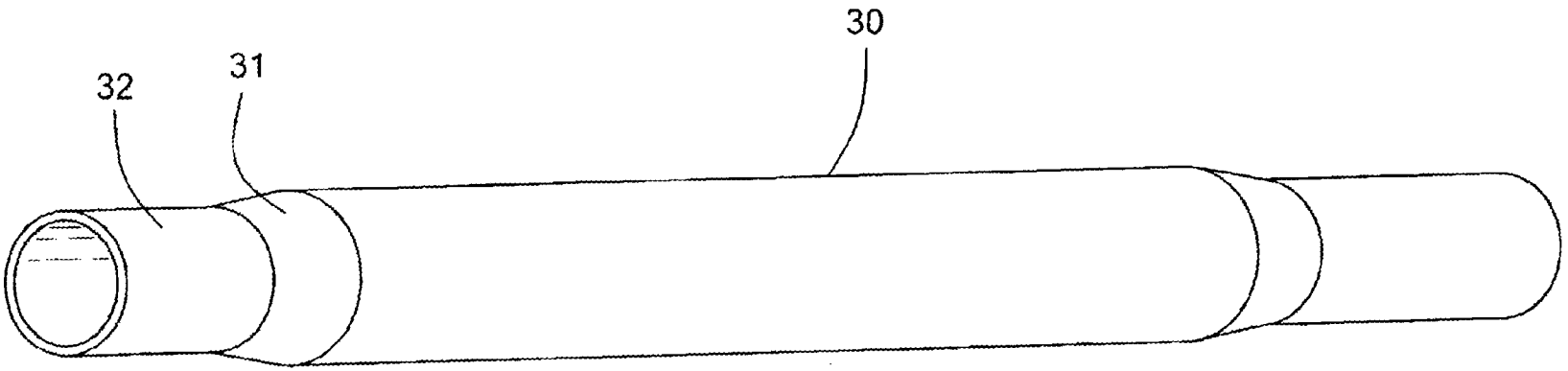
(Prior Art) FIG. 9

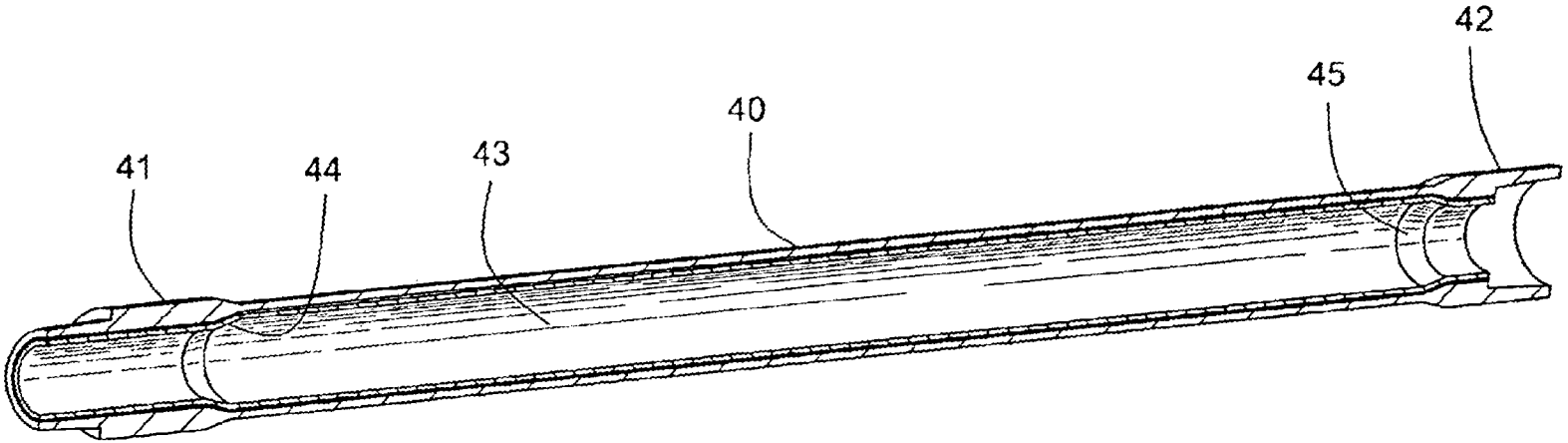
(Prior Art) FIG. 10

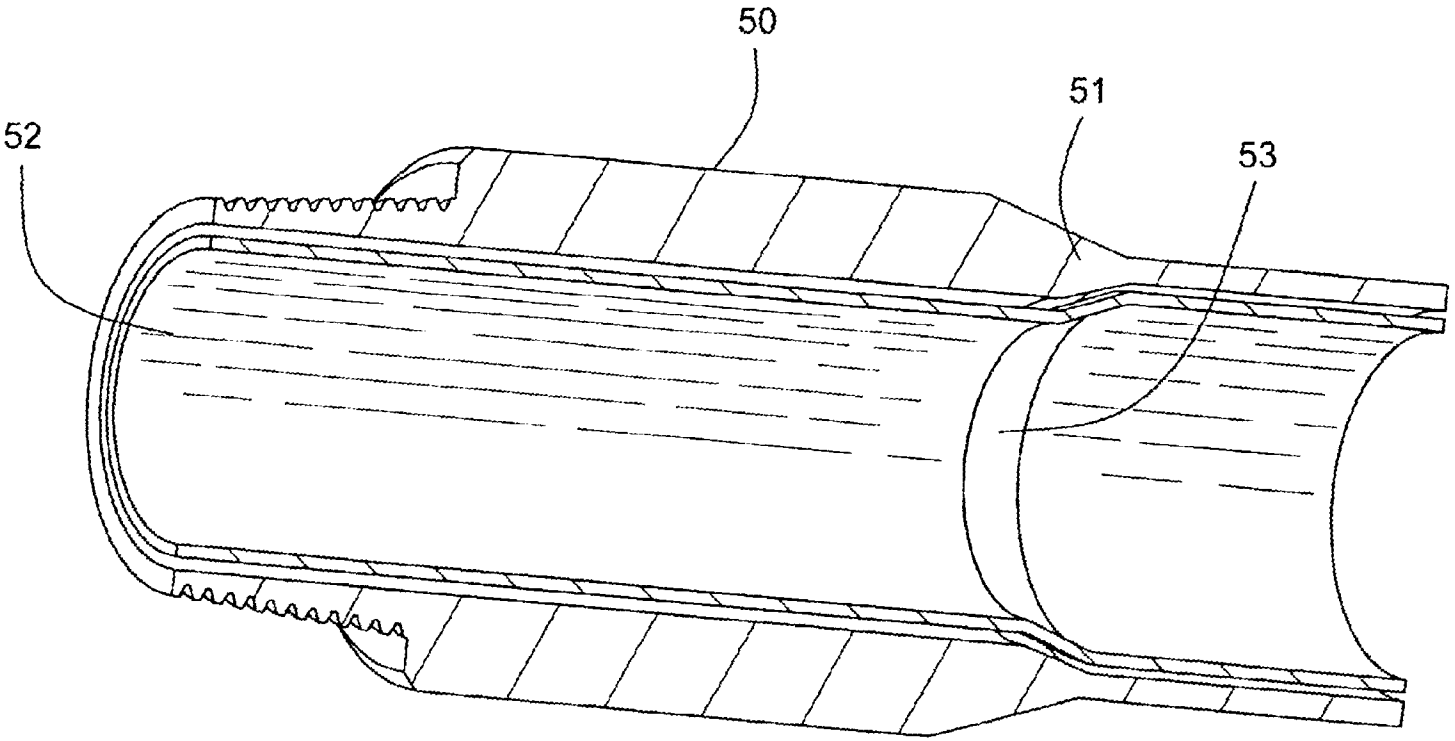
(Prior Art) FIG. 11

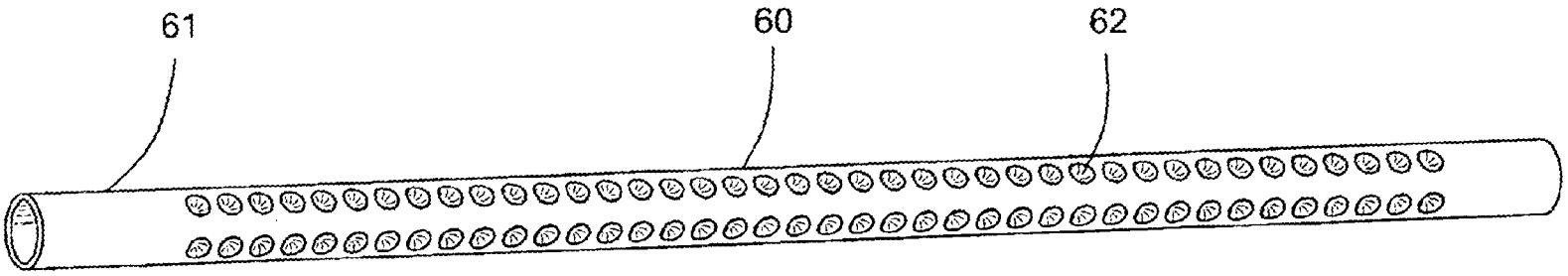
(Prior Art) FIG. 12

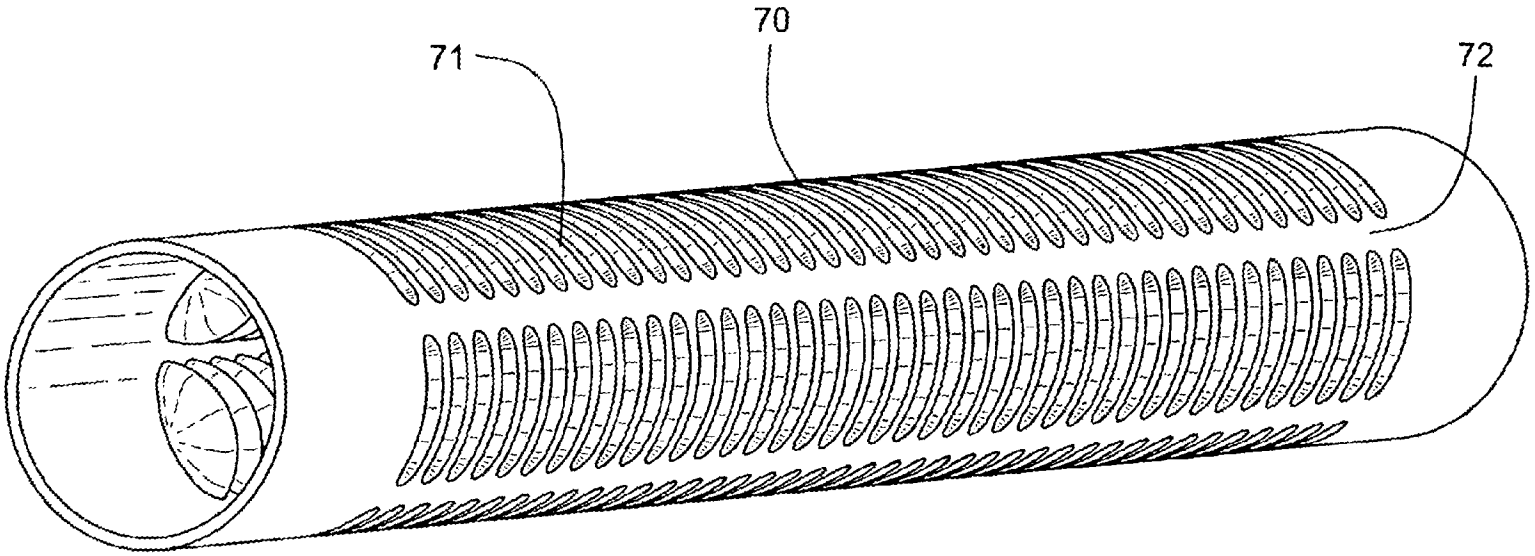
(Prior Art) FIG. 13

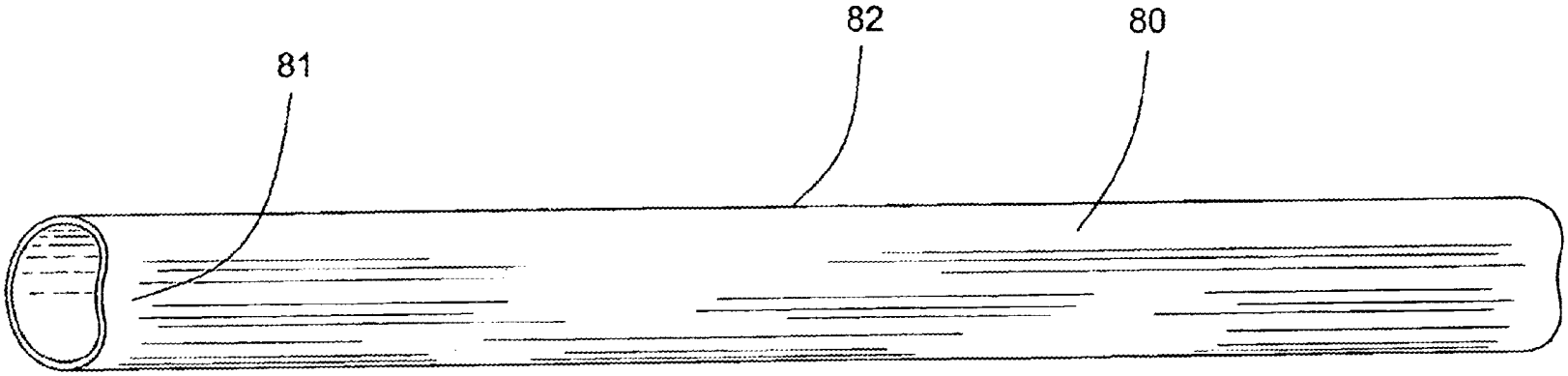
(Prior Art) FIG. 14

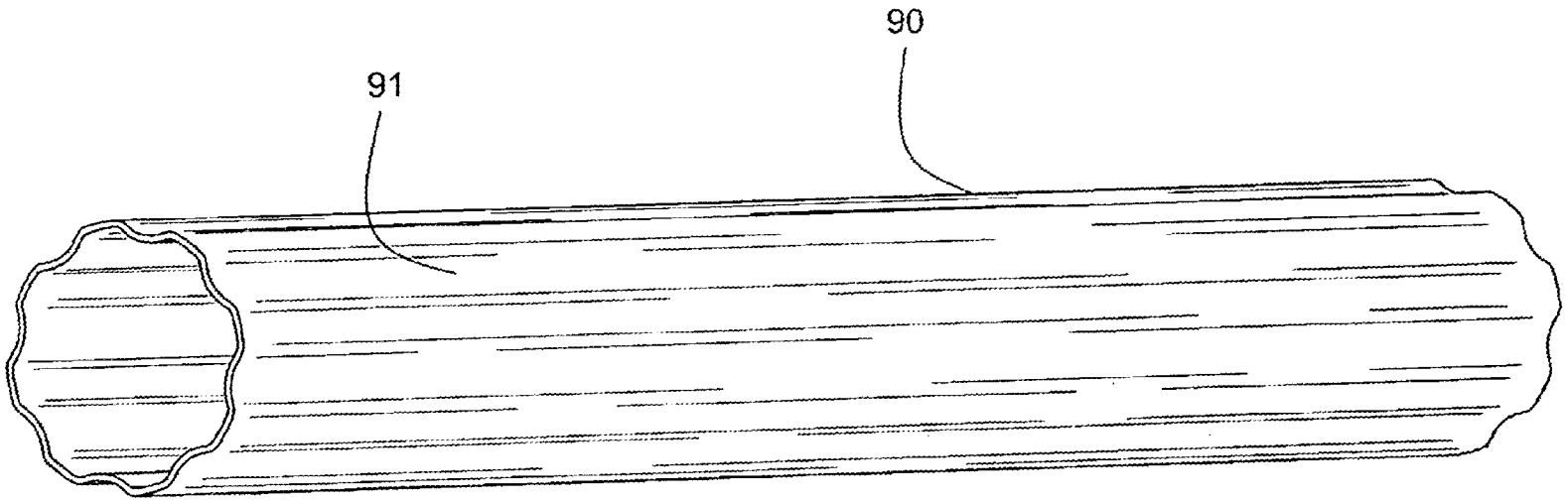
(Prior Art) FIG. 15

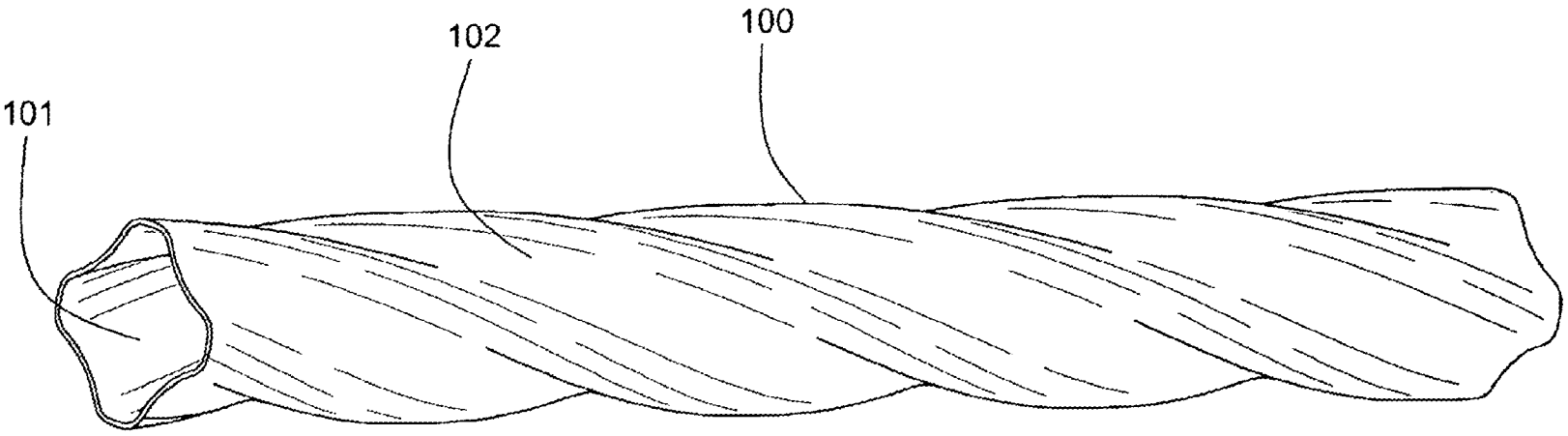
(Prior Art) FIG. 16

LINEABLE TUBULAR

RELATED APPLICATIONS

This application presents a modification and alteration of U.S. Pat. No. 6,799,632, to Hall et al., entitled Expandable Metal Liner for Downhole Components, issued Oct. 5, 2004, which is incorporated herein by this reference for all that it teaches and claims. The prior art figures and teachings are taken from said reference.

U.S. Pat. No. 7,413,021, to Madhavan et al., entitled Method and Conduit for Transmitting Signals, issued Aug. 19, 2008, is incorporated herein by this reference for all that it teaches and claims.

U.S. patent application Ser. No. 17/742,015, to Fox, entitled Upset Telemetry Tool Joint and Method, filed May 11, 2022, is incorporated herein by this reference for all that it teaches and claims.

BACKGROUND OF THE INVENTION

This invention relates to a liner for downhole components. Specifically, this invention is a metal tube having its original uniform shape sufficiently modified by the formation of non-uniform alterations to its shape so that it can be inserted into the bore of a downhole component and then expanded to conform to the interior surface of the downhole component. The shape modifications allow the tube to be expanded beyond its original diameter without rupturing the tube. The application of this invention is useful for any annular component in a production well or a drill string for drilling oil, gas, geothermal wells, or other subterranean excavations.

Provision of a liner in a drill pipe or other downhole component, including well casing, for the purpose of improving the corrosion resistance of the drill pipe or casing and for providing a passageway for electrical conductors and fluid flow is known in the art, as taught by the following references. U.S. Pat. No. 2,379,800, to Hare, incorporated herein by this reference, discloses the use of a protective shield for conductors and coils running along the length of the drill pipe. The shield serves to protect the conductors from abrasion that would be caused by the drilling fluid and other materials passing through the bore of the drill pipe.

U.S. Pat. No. 2,633,414, to Boivinet, incorporated herein by this reference, discloses a liner for an autoclave having folds that allows the liner to be installed into the autoclave. Once the liner is installed, it is expanded against the inside wall of the autoclave using hydraulic pressure.

U.S. Pat. No. 4,012,092, to Godbey, incorporated herein by this reference, discloses an electrical transmission system in a drill string using electrically conductive pipe insulated with a complementary sheath of elastic dielectric liner material. In order to ensure adequate electrical insulation at the ends of each tube, the sheath was slightly longer than its mating tube. The elastic nature of the sheath material enabled it to conform to the geometry of the drill pipe and its joint.

U.S. Pat. No. 2,982,360, to Morton et al., incorporated herein by this reference, discloses a liner for a well casing in a sour well, e.g. a well where hydrogen cracking and embrittlement are believed to be the cause of stress corrosion and failure of metal the well casing. The objective of the disclosure is to provide a liner to protect the casing and other downhole components from the effects of corrosion. A unique feature of this disclosure is that the liner is not bonded to the downhole component, in order to provide some void space between the liner and the component wall. However, it does teach that the metal liner can be expanded against the inside wall of the casing using mechanical or hydraulic pressure.

U.S. Pat. No. 4,095,865, to Denison et al., incorporated herein by this reference, discloses an improved drill pipe for sending an electrical signal along the drill string. The improvement comprises placing the conductor wire in a spiral conduit that is sprung against the inside bore wall of the pipe. The conduit serves to protect the conductor and provides an annular space within the bore for the passage of drilling tools.

U.S. Pat. No. 4,445,734, to Cunningham, incorporated herein by this reference, teaches an electrical conductor or wire segment imbedded within the wall of the liner, which secures the conductor to the pipe wall and protects the conductor from abrasion and contamination caused by the circulating drilling fluid. The liner of the reference is composed of an elastomeric, dielectric material that is bonded to the inner wall of the drill pipe.

U.S. Pat. No. 4,924,949, to Curlett, incorporated herein by this reference, discloses a system of conduits along the pipe wall. The conduits are useful for conveying electrical conductors and fluids to and from the surface during the drilling operation.

U.S. Pat. No. 5,311,661, to Zifferer, incorporated herein by this reference, teaches a method for forming corrugations in the wall of a copper tube. The corrugations are formed by drawing or pushing the tube through a system of dies to reduce the diameter of the end portions and form the corrugations in center portion. Although the disclosure does not anticipate the use of a corrugated liner in drill pipe or other downhole component, the method of forming the corrugations is readily adaptable for that purpose.

U.S. Pat. No. 5,517,843, to Winship, incorporated herein by this reference, discloses a method of making an upset end on metal pipe. The method of the reference teaches that as the end of the metal tube is forged, i.e. upset, the wall thickness of the end of the pipe increases and inside diameter of the pipe is reduced.

An object of the present invention, which is not disclosed or anticipated by the prior art, is to provide a liner that can be adapted for insertion into a downhole component and can accommodate the regular and varying inside diameters found in downhole components. An additional object of the invention is to provide a liner capable of withstanding the dynamic forces and corrosive and abrasive environment associated with drilling and production of oil, gas, geothermal resources, and subterranean excavation.

SUMMARY OF THE INVENTION

The following portion of the summary relates to FIGS. 1-6. The teachings of the prior art figures and related text also relate to said figures except as modified by said figures.

This application presents a lineable tubular, that is a tubular suitable for housing a liner or lining, or a partial liner or lining. The lineable tubular may be a drill pipe or other downhole tool used in a drill string. The lineable tubular may be production tubing. The lineable tubular may be suitable for use in the acquisition and production of subterranean resources. The lineable tubular may comprise a tube or tubular comprising connectable ends. The tubular may comprise a bore comprising an interior surface. At least a portion of the interior surface may comprise surface modifications to enhance retention of the liner or a portion thereof within the bore of the tube. The liner may be pre-formed to match the interior surface of the bore of tubular, or it may be an expandable liner placed within the bore of tubular than then expanded to fit tightly within the bore.

The lineable tubular may comprise a tubular comprising upset portion. The upset portion may provide a thickened tube wall that may facilitate attachment to connectable ends in the form of a tool joint. The upset portion may comprise a conical weld surface and a shoulder weld surface for attachment to mating surfaces of the tool joints. The connectable ends may comprise a pin end tool joint or a box end tool joint that may be connected to the upset portions of the lineable tubular. The tool joints may be attached to the upset portions along the shoulder weld surface and the conical weld surface by means of welding, including MIG—Gas Metal Arc Welding (GMAW), TIG—Gas Tungsten Arc Welding (GTAW), Stick—Shielded Metal Arc Welding (SMAW) and Flux-cored—Flux-cored Arc Welding (FCAW). Also, suitable attachment may be achieved by means of friction welding, rotary friction welding, laser welding, or sonic welding.

The lineable tubular comprising the connectable ends may each comprise an inductive coupler connected by an armored electrical cable running along the length of the tubular. Examples of an inductive coupler may be found in U.S. Pat. No. 7,040,003, to Hall et al., entitled Inductive Coupler for Downhole Components and Method for Making Same, issued May 9, 2006. Said patent is incorporated herein by this reference. The cable may be disposed between the liner and the bore wall interior surface. An example of such a disposition may be found at FIGS. 9A and 9B of the '021 reference.

The lineable tubular may comprise an interior surface having modifications such as spiral grooves and ridges. Another possible modification may comprise rifling. Knurling may be a suitable modification in some instances where more aggressive attachment may be desired. Another form of a surface modification may comprise hard particles and superhard particles. Such hard particles may comprise carbide, silicon carbide, tungsten carbide, and even natural and synthetic diamond particles. In some cases, sand and other grits may be desired as a surface modification. Modification such as spiral threads may also be a suitable modification of the interior surface. Another interior surface modification may comprise hardening the interior surface. Hardening may be achieved by heat heating, by chemical deposition, and or a mechanical process. Chemical hardening may be performed by plating the interior surface. Mechanical hardening may be performed by peening or brinelling the interior surface.

The lineable tubular may comprise a liner that is in contact with at least a portion of the tubular. The liner may comprise a metal liner or a non-metal liner in contact with the interior surface modifications as described herein. Accordingly, the interior surface modifications may be restricted to the upset portions of the tubular and along the bore of the box end and pin end of tool joints.

The respective tool joints may comprise a seal gland. The seal gland may align with a seal gland in a liner inserted into the bore. A seal for protecting the liner's exterior surface and the interior surface from downhole effects of fluids and gases may be disposed within the aligned seal glands.

This invention discloses a liner for downhole annular components comprising an expandable metal tube suitable for conforming to an inside surface of the downhole component, wherein the downhole component may be uniform or non-uniform in cross section and/or material properties. The tube may be formed outside the downhole component and then inserted into the component, or it could be expanded and formed after being inserted into the component. In order to accommodate expansion of the tube and conformity with the interior of the downhole component, the tube is pre-formed with any of a variety of shape modifications comprising convolutions, corrugations, indentations, and dimples that generally increase the circumferential area of the tube and facilitate expansion of the tube to a desired shape. The metal tube may have generally a circular, square, rectangular, oval, or conic cross section, and the outer surface that interfaces with the inner surface of the downhole component may be polished, roughened, knurled, or coated with an insulating material. Depending on the desired application, the tube may be formed with sufficient force inside the component that it remains in compression against the inside surface wall of the component, or it may be expanded to a lesser diameter. For example, in some cases it may be desirable to expand the tube so that it merely contacts the inside wall of the component, or it may be desirable that the tube be expanded to a diameter that provides an annulus, or other space, between the tube and inside surface of the component. Where an annulus is provided, additional equipment such as pumps, valves, springs, filters, batteries, and electronic circuitry may be installed between the tube and the inside wall of the component. The tube also may be formed over one or more electrical or fiber optic conductors or conduits in order to provide protective passageways for these components.

BRIEF DESCRIPTION OF THE DRAWINGS

FIG. 7 is a perspective representation of a downhole component.

FIG. 8 is a perspective representation of a liner of the present invention having a convoluted non-uniform section along the length of the liner.

FIG. 9 is a perspective representation of an expanded liner of the present invention.

FIG. 10 is a sectioned perspective representation of a downhole tool having a liner.

FIG. 11 is an enlarged sectioned perspective representation of the pin end of a downhole tool.

FIG. 12 is a perspective representation of a liner of the present invention having a dimpled non-uniform section.

FIG. 13 is a perspective representation of a liner of the present invention having an ovoid non-uniform section.

FIG. 14 is a perspective representation of a liner of the present invention having a concave non-uniform section.

FIG. 15 is a perspective representation of a liner of the present invention having a corrugated non-uniform section.

FIG. 16 is a perspective representation of a liner of the present invention having a spirally fluted non-uniform section.

DETAILED DESCRIPTION OF THE INVENTION

Figure 1:
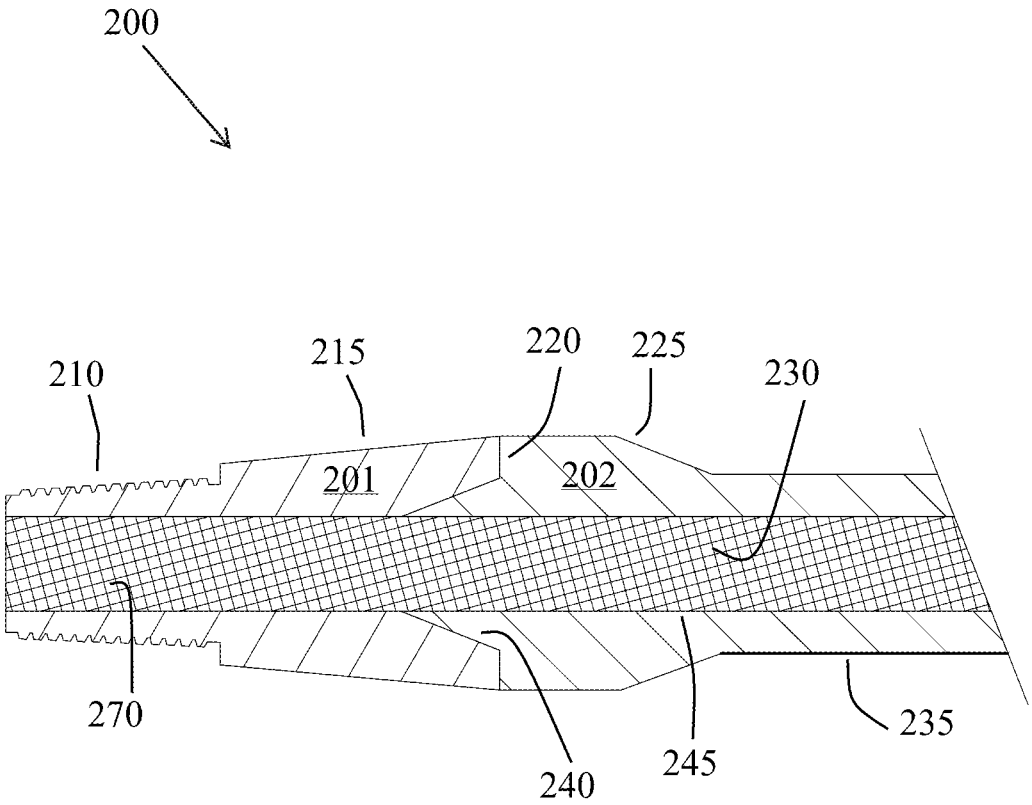
FIG. 1 is a longitudinal half cut diagram of a pin end tubular of the present invention.
Figure 2:
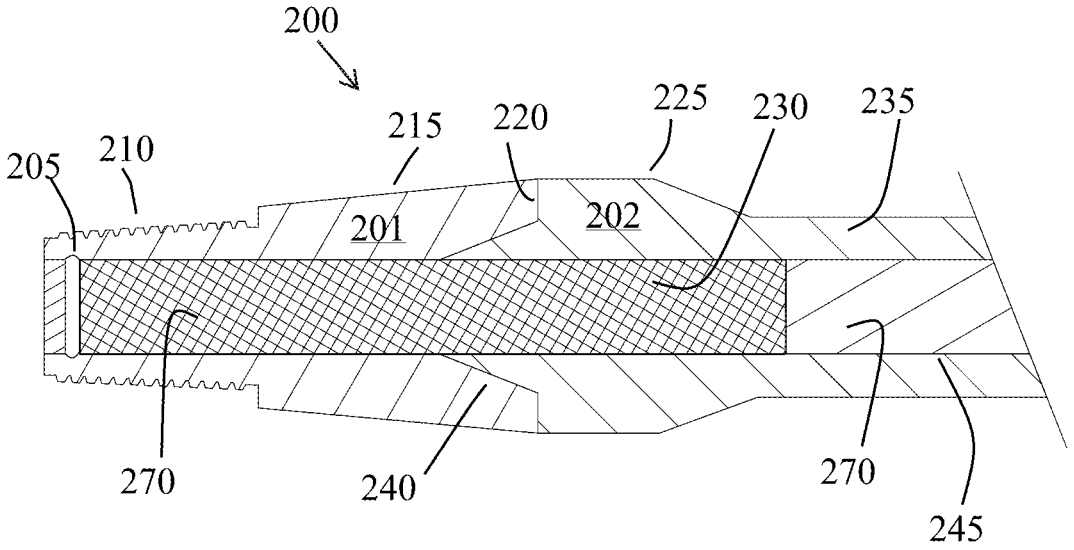
FIG. 2 is an iteration longitudinal half cut diagram of a pin end tubular of the present invention.
Figure 3:
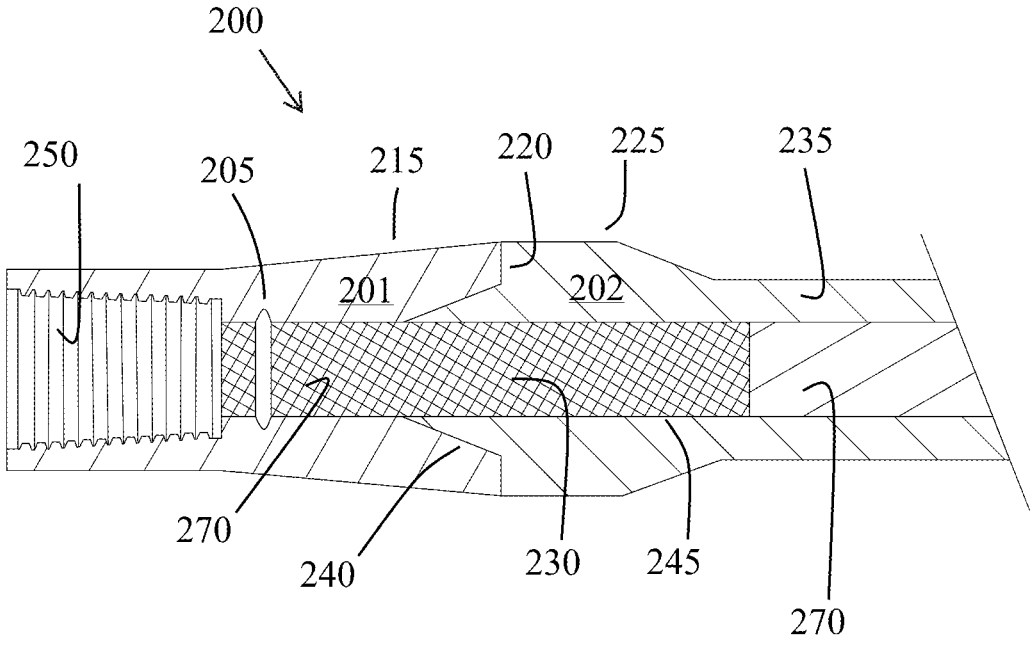
FIG. 3 is a longitudinal half cut diagram of a box end tubular of the present invention.
Figure 4:
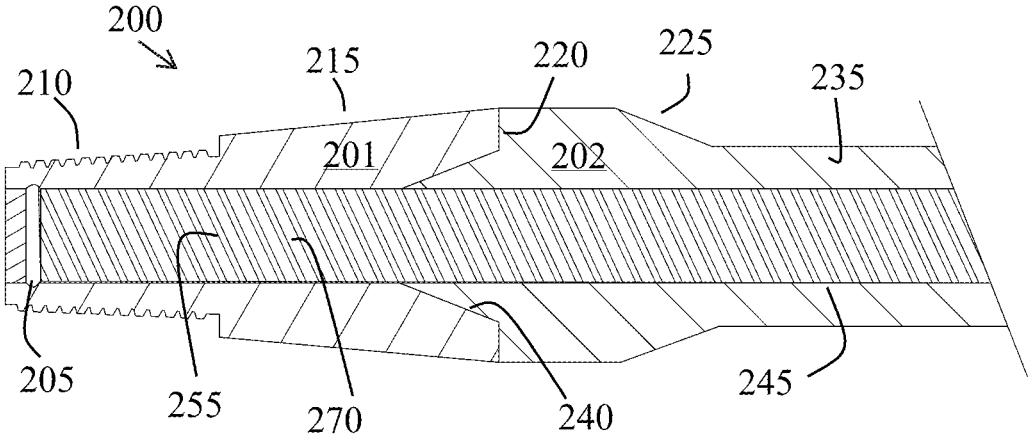
FIG. 4 is a longitudinal half cut diagram of a pin end tubular comprising a modified interior surface.
Figure 5:
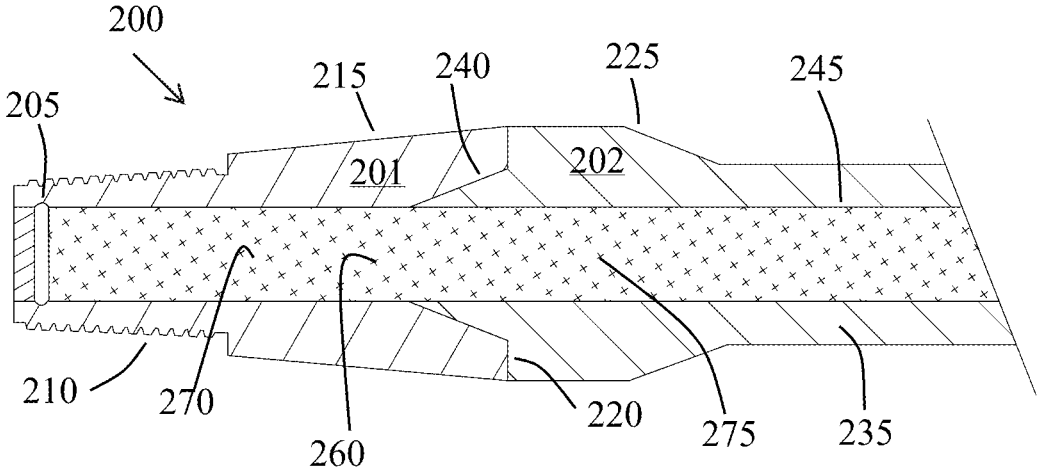
FIG. 5 is another longitudinal half cut diagram of a pin end tubular comprising another modified interior surface.
Figure 6:
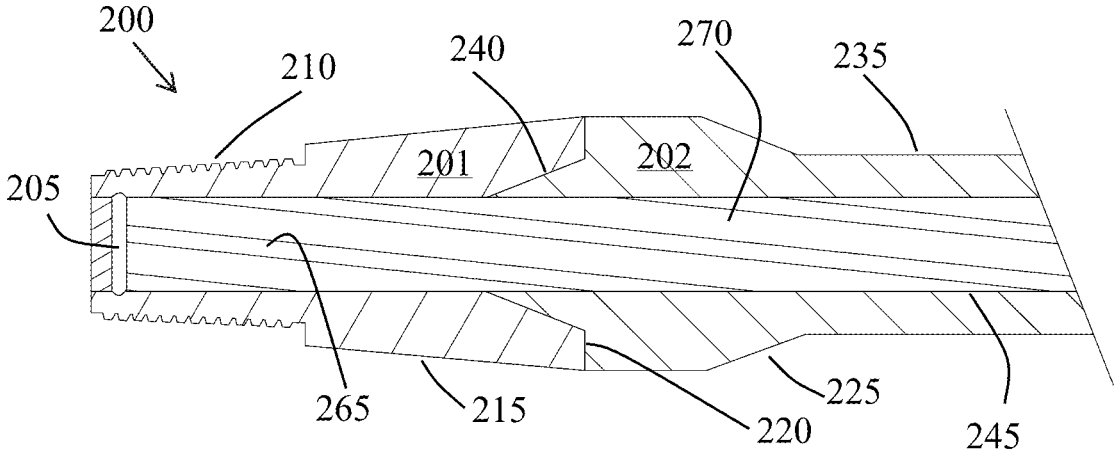
FIG. 6 is another longitudinal half cut diagram of a pin end tubular comprising another iteration of an interior surface.

The following portion of the detail description relates to FIGS. 1 through 6. The prior art figures and the related text apply to said figures except for the modification made herein.

This application presents a lineable tubular 200, that is a tubular suitable for housing a liner or lining, or a partial liner or lining. The lineable tubular 200 may be a drill pipe or other downhole tool used in a drill string. The lineable tubular 200 may be production tubing. The lineable tubular 200 may be suitable for use in the acquisition and production of subterranean resources. The lineable tubular 200 may comprise a tube or tubular 235 comprising connectable ends 201. The tubular 235 may comprise a bore 245 comprising an interior surface 270. At least a portion of the interior surface 270 may comprise surface modifications to enhance retention of the liner or a portion thereof within the bore 245 of the tube 235. The liner may be pre-formed to match the interior surface 270 of the bore 245 of tubular 235, or it may be an expandable liner placed within the bore 245 of tubular 235 than then expanded to fit tightly within the bore 245.

The lineable tubular 200 may comprise a tubular 235 comprising upset portion 202. The upset portion 202 may provide a thickened tube wall 225 that may facilitate attachment to connectable ends 201 in the form of a tool joint 201. The upset portion 202 may comprise a conical weld surface 240 and a shoulder weld surface 220 for attachment to mating surfaces of the tool joints 201. The connectable ends 201 may comprise a pin end 210 tool joint or a box end 250 tool joint that may be connected to the upset portions 202 of the lineable tubular 235. The tool joints 210/250 may be attached to the upset portions 202 along the shoulder weld surface 220 and the conical weld surface 240 by means of welding, including MIG—Gas Metal Arc Welding (GMAW), TIG— Gas Tungsten Arc Welding (GTAW), Stick—Shielded Metal Arc Welding (SMAW) and Flux-cored—Flux-cored Arc Welding (FCAW). Also, suitable attachment may be achieved by means of friction welding, rotary friction welding, laser welding, or sonic welding.

The lineable tubular comprising the connectable ends 201 may each comprise an inductive coupler connected by an armored electrical cable running along the length of the tubular 235. Examples of an inductive coupler may be found in U.S. Pat. No. 7,040,003, to Hall et al., entitled Inductive Coupler for Downhole Components and Method for Making Same, issued May 9, 2006. Said patent is incorporated herein by this reference. The cable may be disposed between the liner and the bore wall interior surface 270. An example of such a disposition may be found at FIGS. 9A and 9B of the '021 reference.

The lineable tubular 200 may comprise an interior surface 270 having modifications such as spiral grooves and ridges 265/255. Another possible modification may comprise rifling 265. Knurling 230 may be a suitable modification in some instances where more aggressive attachment may be desired. Another form of a surface modification may comprise hard particles 260 and superhard particles 275. Such hard particles may comprise carbide, silicon carbide, tungsten carbide, and even natural and synthetic diamond particles. In some cases, sand and other grits may be desired as a surface modification. Modification such as spiral threads 255 may also be a suitable modification of the interior surface 270. Another interior surface 279 modification may comprise hardening the interior surface 270. Hardening may be achieved by heat heating, by chemical deposition, and or a mechanical process. Chemical hardening may be performed by plating the interior surface 270. Mechanical hardening may be performed by peening or brinelling the interior surface 270.

The lineable tubular 200 may comprise a liner that is in contact with at least a portion of the tubular 235. The liner may comprise a metal liner or a non-metal liner in contact with the interior surface 270 modifications as described herein. Accordingly, the interior surface 270 modifications may be restricted to the upset portions 202 of the tubular and along the bore 245 of the box end 250 and pin end 210 of tool joints 201.

The respective tool joints 201 may comprise a seal gland 205. The seal gland 205 may align with a seal gland in a liner inserted into the bore 245. A seal for protecting the liner's exterior surface and the interior surface 270 from downhole effects of fluids and gases may be disposed within the aligned seal glands.

Generally, downhole components are constrained within an annular geometry and capable of being connected to each other at designated locations along the drill string or along the well casing of an oil, gas, or geothermal well. Downhole components include drill pipe, drill collars, heavy weight drill pipe, casing, reamers, jars, shock absorbers, bit boxes, electronic subs, packers, bent subs, perforators, hydraulic motors, turbines, generators, pumps, down-hole assemblies, and batteries. The annular configuration of the components in a drill string is necessary in order to accommodate the flow of drilling fluid to the bit and for the insertion of well logging equipment and other tools into the borehole. In a production well, the annular components enable the flow of oil and gas to the surface and provide means for installing pumps, sensors, and other equipment into the producing well. One of the objectives of this invention, therefore, is to provide a liner that is capable of accommodating the various interior surfaces of the annular downhole components. The liner of this invention is useful for improving the hydraulics of fluid flow through the component, for increasing the component's resistance to corrosion, and for securing other sub-assemblies and equipment inside the downhole component.

Since downhole components share the annular geometry of a drill pipe, the detailed description of this invention will be directed to a liner within that downhole component. However, those skilled in the art will immediately recognize the application of this invention to the other downhole components that make up the drill string or production tubing in a well.

The following portion of the detail description is taken from the '632 reference and applies to the FIGS. 1-6 except as modified by said figures.

FIG. 7 is a perspective representation of a length of drill pipe (13) having a pin end tool joint (14) and a box end tool joint (15). The tool joints have thickened cross sections in order to accommodate mechanical and hydraulic tools used to connect and disconnect the drill string. Drill pipe usually consists of a metal tube to which the pin end tool joint and the box end tool joint are welded. Similar tool joints are found on the other downhole components that make up a drill string. The tool joints may also have a smaller inside diameter (18), in order to achieve the thicker cross section, than the metal tube and, therefore, it is necessary to forge, or "upset", the ends of the tube in order to increase the tube's wall thickness prior to the attachment of the tool joints. The upset end portion (19) of the tube provides a transition region between the tube and the tool joint where there is a change in the inside diameter of the drill pipe. High torque threads (16) on the pin end and (17) on the box end provide for mechanical attachment of the downhole tool in the drill string. Another objective of this invention, therefore, is to provide a liner that will accommodate the varying diameters inside a drill pipe or other downhole component and not interfere with the make up of the drill string.

FIG. 8 is an illustration of a liner (20) of the present invention. It comprises a metal tube having uniform end portions (21) and a non-uniform section consisting of intermediate corrugations (22). In this figure, the corrugations extend longitudinally along the length of the tube, parallel to the axis of the tube. At the ends of each corrugation are transition regions that may generally correspond to the transitional regions within the upset drill pipe. The wall thickness of this liner may range from between about one half the wall thickness to greater than the thickness of the tube wall. Suitable metal materials for the liner may be selected from the group consisting of steel, stainless steel, aluminum, copper, titanium, nickel, molybdenum, and chromium, or compounds or alloys thereof. The liner is formed by providing a selected length of tubing having an outside diameter less than the desired finished diameter of the liner and drawing the tube through one or more dies in order to form the end portions and corrugations. The outside diameter of the liner may also be reduced during this process. Alternatively, the convolutions are formable by metal stamping, hydroforming, or progressive roll forming. In cases where the entry diameter of the tool joint is smaller than the inside diameter of the tube, the outside diameter of the tube may need to be decreased during the process of forming the end portions and corrugations, so that it can be inserted into a downhole component such as the drill pipe of FIG. 7. Once the tube is inside the component, the tube is plugged and hydraulically or mechanically expanded to its desired diameter. The shape modification in the tube allow the tube to expand to at least its original outside diameter and beyond, if so desired, without excessively straining the material of the tube. In this fashion the tube can accommodate the changing inside diameter of the downhole component. Another method of expanding the tube is depicted in U.S. Pat. No. 2,263,714, incorporated herein by this reference, which discloses a method of drawing a mandrel through a lining tube in order to expand it against the wall of a pipe. Although the reference does not anticipate a varying inside diameter, the mandrel could be adapted, according to the present invention, to vary with the varying size of the tube within the downhole component.

FIG. 9 is a representation of the expanded liner (30) of the present invention. For clarity the downhole component into which the liner has been expanded is not shown. The non-uniform section of the liner has been expanded to accommodate a downhole component having a changing diameter in the transition region (31) and a smaller inside diameter at end portions (32). For example, in order to provide a liner for an upset, 5⅞" double-shouldered drill pipe obtainable from Grant Prideco, Houston, Tex., having a tool joint inside diameter of approximately 4¼" and a tube inside diameter of approximately 5", a 316 stainless steel tube of approximately 33' in length and having a wall thickness of about 0.080" was obtained. The stainless steel tube was drawn through a series of tungsten-carbide forming dies at Packless Metal Hose, Waco, Tex., in order to draw down the outside diameter of the tube to about 4.120". At the same time, the carbide dies formed the end portions and the corrugations of the non-uniform section similar to those shown in FIG. 7. A tube similar to that shown at FIG. 7 was then inserted into the drill pipe, and the assembly was placed inside a suitable press constructed by the applicants. The end of the tube portions were sealed using hydraulic rams that were also capable of forcing pressurized water into the tube. Once the tube was completely filled with water, the pressure of the water was increased in order to expand the tube to match the inside diameter of the downhole tool, i.e. drill pipe. At around 150 psi the corrugations began to move or expand, as was evidenced by noises coming from inside the pipe as the corrugations buckled outward. The pressure was increased to between 3500 and 5000 psi whereupon the expansion noises nearly ceased. The applicants concluded that at about this time the liner was fully expanded against the inside wall of the pipe. Pressure inside the tube was then increased to above 10,000 psi whereby it is thought that the pipe expanded within its elastic limit, while the liner expanded beyond its plastic limit, thereby placing the liner in compression against the inside wall of the pipe after removal of pressure. When the pipe was removed from the press, visual inspection revealed that the liner had taken on the general shape as depicted in FIG. 9, and that the liner had been fully expanded against the inside diameter of the drill pipe. The applicant attempted to vibrate and remove the liner but found that it was fixed tightly inside the pipe.

FIG. 10 is an axial cross-section representation of a drill pipe (40) similar to that depicted in FIG. 7 with a liner (43) similar to that shown in FIG. 9. The thickened wall (41) of the pin end and the thickened wall (42) of the box end tool joints are depicted. The upset transition regions (44) at the pin end and (45) at the box end are also identified. For clarity, the liner (43) is shown not fully expanded against the inside wall of the drill pipe (40). However, as the liner is fully expanded against the inside wall of the downhole tool, the transition regions serve to lock the liner in place so that the liner is not only held in position by being in compression against the wall of the pipe but is also locked in position by the changing inside diameter. A liner thus installed into a downhole tool has many advantages. Among these are the improvements of the hydraulic properties of the bore of the tool as well as corrosion and wear resistance.

FIG. 11 is an enlarged representation of the pin end of FIG. 10. The thickened wall (50) of the tool joint is identified as well as the transition region (51) of the downhole tool. In the liner (52), the transition region (53) is depicted. Once again for clarity, the liner is depicted not fully expanded against the inside wall of the pipe. In actuality, at this stage of expansion, where the liner is not fully expanded, it is expected that the remains of the corrugations would still be visible. It is not expected that the corrugations would be fully ironed out until the tube is fully pressed against the tool wall. It will be noted that where differing materials are used, for example where the tool consists of 4100 series steel and the liner is a stainless steel, the intimate contact of the differing materials may induce a corrosive condition. In order to prevent galvanic corrosion, the liner or the tool, or both, may be coated with an electrically insulating material that would interrupt any galvanic current that might form when the liner and tool surface come in contact with each other in the presence of an electrolyte.

FIG. 12 illustrates a liner (60) having end portions (61) and a non-uniform section of dimpled indentations (62) along the length of the tube. The dimples could be positive or negative with respect to the surface of the liner. As depicted the dimples are generally round in shape, but they could be ovoid or elongated as shown in FIG. 13, and the properties of FIG. 12 are applicable to the properties of FIG. 13, and vice versa, where the non-uniform section of the tube (70) has ovoid indentations (71). Although, the dimple pattern as shown is regular in both figures along the longitudinal axis of the tube, alternative patterns are possible and could be beneficial. For example, the pattern could be spiral or the pattern could consist of a combination of shapes alternating within the border region (72).

FIG. 14 is a representation of another non-uniform section of the present invention provided in a tube. The deformation consists of a single corrugation (81) along the full lengthwise axis of the tube (80). Multiple corrugations are possible, but a single corrugation may be adequate. This design could also be used in connection with the regular end portions of FIG. 8. This modified "D" configuration is appealing for its simplicity in design, and yet it is capable of accommodating a downhole tool having a regular inside diameter. Tests by the applicants have shown that both thick and thin-walled tubing, having a thickness between about 0.010" and about 0.120" benefit from the non-uniform section of the present invention during expansion. Without the non-uniform section, finite-element analysis has shown that the liner will likely rupture before it is sufficiently expanded against the tool wall. The configuration depicted in FIG. 14 may be useful in situations where it is desired to place a conduit or conductor cable along the inside of the downhole tool. The corrugation would provide a pathway for the conduit and would form itself around the conduit during expansion. In this embodiment not only would the liner benefit the performance of the pipe, but it would also serve to fix the conduit or cable in place and protect it from the harsh downhole environment.

FIG. 15 is a representation of a non-uniform section (91) provided in a tube (90). The non-uniform section consists of longitudinal corrugations that may or may not extend the full length of the tube. As depicted, the corrugations are at regular intervals around the circumference of the tube, however, the applicants believe that an irregular pattern may be desirable depending on the configuration of the inside wall against which the tube will be expanded. The desired depth of the corrugations as measured perpendicularly from the crest of the outer-most surface to the inside diameter as represented by the inner most surface of the trough may be determined by the total expansion required of the liner. For example, if the liner were to be installed into a downhole tool having a uniform inside diameter, the corrugations would not have to be as deep as the corrugations would need to be if the liner were to be installed into a tool having a varying inside diameter. For example, for a tool having a uniform inside diameter, the depth of the corrugations could be approximately equivalent to one half of the wall thickness of the tube prior to formation of the corrugations and be adequate to achieve sufficient expansion inside the tool, depending on the number of corrugations and their proximity to each other. On the other hand, where the inside wall of the tool has a varying diameter, the corrugations may have to exceed the greatest variation between inside diameter irregularities. These critical dimensions are best obtained for a given tool design by experimenting with the thickness and shape of the non-uniformities. The determination of optimum dimensions is included within the teachings of the liner of the present invention.

FIG. 16 is a representation of the liner of FIG. 15 modified so that the liner (100) exhibits a non-uniform section along its length consisting of an inner wall (101) and an outer wall (102) made up of indentations that are formed into spiral flutes. This configuration would be useful in downhole tools having uniform inside wall surfaces. The flutes could be proportioned so that conduits and conductors could be disposed within the troughs and run along the full length of the downhole tool. Such conduits and conductors would then be protected from the harsh fluids and tools that are circulated through the tool's bore. In cases where it would be desirable to control the flow of fluid through the bore of the downhole tool, it may be desirable to expand the liner in such a manner so that the form of the indentations remain in the inside wall of the liner after it has been fully expanded. The modified flow produced by the presence of indentations in the inner wall of the downhole tool might be beneficial in reducing turbulence that tends to impede efficient flow of fluid through the tool.

Other and additional advantages of the present invention will become apparent to those skilled in the art and such advantages are incorporated in this disclosure. The figures presented in this disclosure are by way of illustration and are not intended to limit the scope of this disclosure.

The invention claimed is:

1. A lineable tubular, comprising:

a tubular suitable for use in the acquisition and production of subterranean resources;

the tubular comprising connectable end portions;

the tubular comprising a bore comprising an interior wall surface;

at least a portion of the interior surface comprising raised ridged interior wall surface modifications within the tubular and the connectable end portions that increase interior surface retention with a liner disposed within the bore, wherein the liner disposed within the bore comprises an annular seal gland proximate its ends adapted to align with an annular seal gland within the interior surface of the bore of the tool joints.

2. The lineable tubular of claim 1, wherein the tubular connectable end portions comprises upset end portions.

3. The lineable tubular of claim 2, wherein the connectable end portions comprise a pin end and a box end tool joint connected to the upset end portions of the lineable tubular.

4. The lineable tubular of claim 1, wherein the tubular comprises a drill pipe.

5. The lineable tubular of claim 4, wherein the tubular comprises a downhole tool connectable to the drill pipe.

6. The lineable tubular of claim 1, wherein the connectable end portions each comprise an inductive coupler connected by an armored electrical cable running along the length of the tubular.

7. The lineable tubular of claim 1, wherein the raised ridged interior wall surface modifications comprise spiral grooves and ridges.

8. The lineable tubular of claim 1, wherein the raised ridged interior wall surface modifications comprise rifling.

9. The lineable tubular of claim 1, wherein the raised ridged interior wall surface modifications comprise knurling.

10. The lineable tubular of claim 1, wherein the raised ridged interior wall surface modifications comprise hard particles.

11. The lineable tubular of claim 1, wherein the raised ridged interior wall surface modifications comprise spiral threads.

12. The lineable tubular of claim 1, wherein at least a portion of the tubular comprises a metal liner in contact with the raised ridged interior wall surface modifications.

13. The lineable tubular of claim 1, wherein at least a portion of the tubular comprises a non-metal liner in contact with the raised ridged interior surface modifications.

14. The lineable tubular of claim 1, wherein at least a portion of the raised ridged interior wall surface modifications comprises a hardened raised ridged interior wall surface.

15. The lineable tubular of claim 1, wherein at least a portion of the raised ridged interior wall surface modifications comprise super hard particles.

16. The lineable tubular of claim 2, wherein the upset end portions of the tubular comprise an annular radial shoulder weld surface joining an annular axially tapered conical weld surface.

17. The lineable tubular of claim 2, wherein the raised ridged interior wall surface modifications are restricted to upset end portions of the tubular and along the bore of a box end and a pin end tool joints.

18. The lineable tubular of claim 3, wherein the respective tool joints comprise an annular seal gland radially circumscribing the interior surface of the bore of the tool joints.

19. The lineable tubular of claim 1, wherein a seal is disposed within the respective seal glands.

* * * * *